United States Patent [19]

Snipes

[11] 4,102,952

[45] Jul. 25, 1978

[54] FUEL BURNING CONTROL APPARATUS

[76] Inventor: Thayer Snipes, 5828 Swallow, El Paso, Tex. 79924

[21] Appl. No.: 818,826

[22] Filed: Jul. 25, 1977

[51] Int. Cl.[2] ..... F02M 17/12

[52] U.S. Cl. ..... 261/44 A; 261/DIG. 24

[58] Field of Search ..... 261/44 A, 41 B, DIG. 24

[56] References Cited

U.S. PATENT DOCUMENTS

| | | | |
|---|---|---|---|
| 771,985 | 10/1904 | Kingston | 261/44 A |
| 920,979 | 5/1909 | Morehouse | 261/41 B |
| 2,801,086 | 7/1957 | Fish | 261/44 A |
| 2,995,349 | 8/1961 | Kennedy, Sr. | 261/44 A |
| 3,202,404 | 8/1965 | Brandwood et al. | 261/44 A |
| 3,341,185 | 9/1967 | Kennedy, Sr. | 261/44 A |

FOREIGN PATENT DOCUMENTS

| | | | |
|---|---|---|---|
| 29,834 of | 1910 | United Kingdom | 261/44 A |
| 115,823 | 6/1921 | United Kingdom | 261/44 A |
| 1,417,607 | 10/1975 | United Kingdom | 261/44 A |

*Primary Examiner*—Tim R. Miles
*Attorney, Agent, or Firm*—Marcus L. Bates

[57] ABSTRACT

A fuel control apparatus in the form of a carburetor which includes a hollow shaft mounted transversely within the carburetor throat with the ends thereof extending externally of the carburetor so that a throttle control lever can be attached to one end while the opposed end threadingly engages a stationary needle valve assembly. A butterfly valve element is affixed to a medial length of the shaft. Ports are provided adjacent to the butterfly and a seat is located between the needle valve and the ports so that as the throttle moves the butterfly valve, the needle valve element is moved toward or away from the seat. A fuel flow passageway is provided through the needle valve and into an annulus formed within the shaft and upstream of the seat so that when the valve element is displaced from the seat fuel can flow therethrough, into the medial portion of the hollow shaft, and through the fuel ports thereof.

7 Claims, 4 Drawing Figures

FUEL BURNING CONTROL APPARATUS

BACKGROUND OF THE INVENTION

Fuel control apparatus in combination with internal combustion engines generally include a throttle actuated butterfly valve for controlling the flow of air through a venturi. The venturi has associated therewith a fuel flow passageway located in the low pressure area thereof so that fuel can be sucked from a float chamber into the venturi in direct portion to the mass flow of air through the venturi.

The quantity of fuel which flows from the float chamber into the venturi is proportional to the liquid level contained within the float chamber. The complexity of this type carburetor depends upon the various different expedients employed in order to cause the fuel air ratio to approximate a constant value. Therefore, the closer the air fuel ratio approaches a constant value for all ranges of mass flow, the more expensive the carburetor becomes because of the various different complex fuel control devices which must be included therewith.

As air flows through a carburetor, there is a rapid drop in pressure across the butterfly valve thereof with there being a low pressure area effected immediately downstream of the butterfly valve. Others have proposed to utilize the relative motion between the butterfly valve and the valve body in order that a metered quantity of fuel proportional to the area between the butterfly valve and the valve body might be delivered thereby providing an acceptable air fuel ratio for most ranges of flow for the carburetor. For example, attention is directed to the following prior art which employs various different expedients for attaining this type of fuel system:

Maxwell 795,357; Shakespeare 1,129,129; Rhoads 1,305,744; Wasserlein 1,374,262; Eiker 1,718,735; Kennedy 3,341,185; Firth 2,190,314; Kennedy 2,995,349; Brandwood 3,202,404.

As evidenced by the foregoing prior art patents, fuel flow devices of the above type are extremely complex in operation and require numerous different moving parts so that the resulting apparatus is expensive in initial cost and difficult to maintain. It would, therefore, be desirable to significantly simplify fuel flow apparatus of this type so that the resulting device requires a minimum number of co-acting parts and the initial cost thereof is nominal. Furthermore, it would be desirable that such an apparatus be efficient in design, easily adjusted to permit enrichment of the air fuel ratio, and be economical in operation.

Furthermore, it is desirable that there be provided an apparatus by which prior art carburetors can be modified to include a fuel control device of the above type.

SUMMARY OF THE INVENTION

This invention includes a fuel control apparatus having a main hollow body through which air and fuel flows to the intake manifold of an internal combustion engine. A butterfly valve controls the flow of air through the hollow body. A fuel metering device is associated with the butterfly valve shaft so that axial movement of the shaft moves the butterfly valve and simultaneously meters a finite quantity of fuel into the air stream thereby providing a predetermined air fuel ratio.

More specifically the invention comprehends a hollow valve shaft mounted transversely in the hollow body with opposed marginal ends thereof extending therefrom, with the butterfly valve element being mounted on the hollow shaft within the main body and arranged so that axial rotation of the shaft moves the butterfly valve element from a closed to an opened position. Lateral flow ports are formed in a medial length of the shaft. A needle valve assembly is mounted to the hollow body and engages one marginal end of the hollow shaft in such a manner that the needle valve engages a needle valve seat in response to axial movement of the hollow shaft.

Accordingly, a primary object of the present invention is the provision of improvements in flow control devices for an internal combustion engine.

A further object of the present invention is the provision of a fuel control apparatus having a needle valve assembly which is moved toward and away from a needle valve seat concurrently with movement of a butterfly valve.

Another object of this invention is the provision of a fuel control apparatus comprising a butterfly valve which varies the air flow opening through a main body and a needle valve assembly is positioned respective to a valve seat in direct proportion to axial movement of the butterfly valve.

A further object of the present invention is the provision of improvements in fuel control apparatus which greatly simplifies carburetors of the prior art.

Still a further object of the present invention is the provision of an air flow and fuel flow valve assembly which can be incorporated into prior art carburetors for improving the fuel flow characteristics thereof.

The above objects are attained in accordance with the present invention by the provision of a combinatin of elements whch are fabricated in a manner substantially as described in the above abstract and summary.

These and various other objects and advantages of the invention will become readily apparent to those skilled in the art upon reading the following detailed description and claims and by referring to the accompanying drawings.

DETAILED DESCRIPTION OF THE PREFERRED EMBODIMENT

Figure 1:
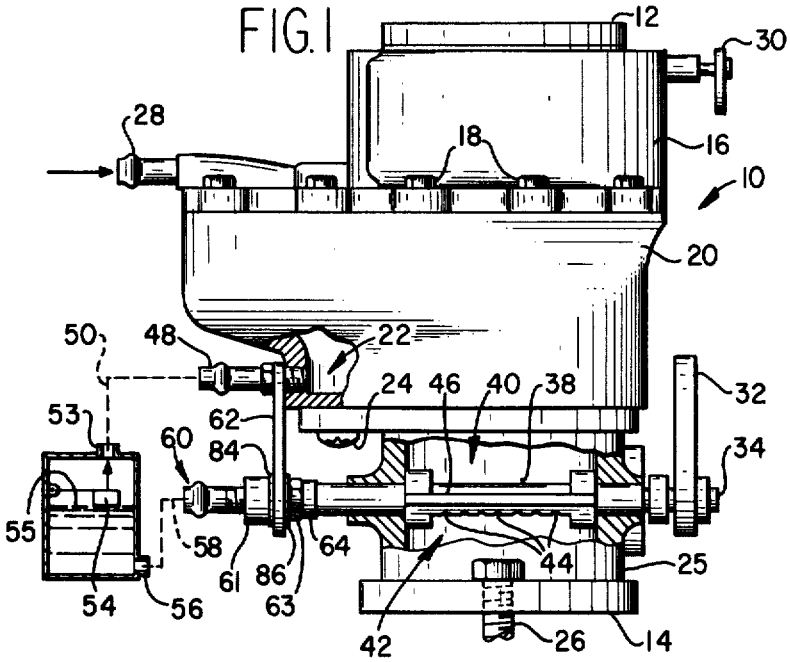
FIG. 1 is a side elevational view of a fuel flow control apparatus made in accordance with the present invention, with some parts being broken away therefrom and some of the remaining parts being shown in cross section.
Figure 2:
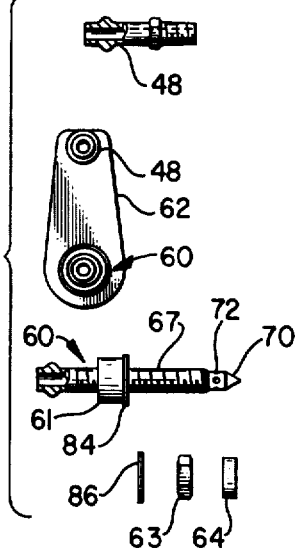
FIG. 2 is an exploded view which illustrates the details of part of the apparatus disclosed in FIG. 1.

In FIG. 1 a carburetor 10 is comprised of a main hollow body having one end 12 opened to the atmosphere and adapted to be connected at the other end 14 to the intake manifold of an internal combustion engine (not shown). The carburetor includes an upper portion 16 bolted at 18 to a lower portion 20. A float chamber 22 has the usual float and needle valve assembly (not shown) included therein so that a constant fuel level is maintained therewithin. Bolts 24 attach hollow member 25 to the member 20 while bolts 26 attach the entire carburetor to the intake manifold of an internal combustion engine.

As seen in various ones of FIGS. 1–4, a main fuel inlet 28 supplies fuel to the beforementioned float chamber 22. Choke 30 controls the flow of air through the upper section 16. Throttle lever 32 is attached to a marginal end of a hollow shaft 34 so that pivotal movement of the lever imparts axial rotation into the hollow shaft. The shaft has an opposed marginal end 36 extending from the opposed end of the carburetor.

A medial portion 38 of the hollow shaft is mounted transversely in the hollow body. A butterfly valve element 46 is attached to the hollow shaft and is movable from a closed and an opened position, and vice versa, by axial rotation of the hollow shaft, thereby providing a high pressure area 40 and a low pressure area 42 as air flows through the carburetor. A plurality of ports 44 are formed in the medial portion of the shaft through which fuel can flow into the low pressure area 42.

As diagrammatically illustrated in FIG. 1, a fuel outlet 48 is connected by any suitable flow conduit 50 and to a secondary float chamber 52. Fuel inlet 53 includes a valve seat against which a needle valve assembly is manipulated by means of the illustrated float assembly 54, thereby providing a constant fuel level 55. The lower end 56 of the float chamber is connected to a stationary metering assembly 60 by means of a flow line 58.

As seen illustrated in FIGS. 1–4, the metering assembly 60 of the present invention is supported from a bracket 62 and includes adjustment nuts 61 and 63 for laterally positioning a threaded body portion 67 respective thereto. Resilient seal member 64 is telescopingly received about the threaded area 67.

The bracket 62 is attached to the main hollow body of the carburetor by means of the beforementioned fuel outlet 48 which includes wrench surface 65 thereon by which the threaded marginal end 66 can be threadedly mated with the illustrated aperture formed within the float chamber housing.

Axial passageway 68 extends through the fuel metering device 60 into proximity of the needle valve element 70. Apertures 72 are formed radially within the illustrated reduced diameter marginal end portion of the apparatus 60.

End 74 of the hollow shaft 38 is in the form of a circumferentially extending shoulder which abuttingly engages the end of a resilient seal 64. Hollow passageway 75 is threaded at 76 for threadedly receiving a tubing coupling 77 by which a manifold pressure gage can be attached for monitoring the pressure effected in the hollow shaft 38.

The opposed end of the hollow shaft is threaded at 78 for threadedly engaging threads 67 formed externally on the metering device 60. Valve seat 80 separates the medial interior portion 82 of the hollow shaft from the needle valve element. The seat is made complimentary respective to the needle valve element 70 so that threads 67 and 78 may be mated and the valve element 70 seated against seat 80, thereby controlling the fuel flow from passageway 68 into passageway 82.

Figure 3:
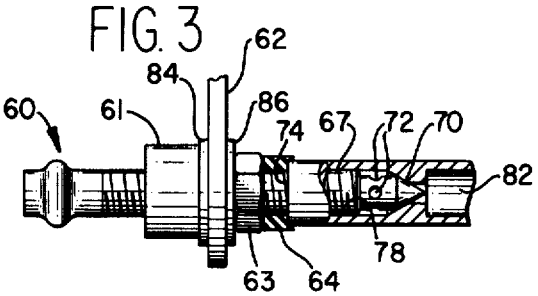
FIG. 3 is an enlarged, fragmentary, detailed, part cross-sectional representation of part of the apparatus disclosed in FIG. 1; and, FIG. 4 is an enlarged, disassembled, part cross-sectional representation of part of the apparatus disclosed in FIG. 1.

As seen in FIG. 3, washers 86 and 84 can be positioned about the metering device 60. The fasteners 61 and 63 are affixed to the bracket and to the metering device 60 in a manner to dispose the valve element 70 in seated relationship respective to the valve seat 80 when the lever 32 closes the butterfly valve 46.

In operation, as the lever 32 axially rotates the shaft 34, the difference in pressure at 40 and 42 causes fuel to flow from inlet 28, into the float chamber 22, through outlet 48, into the chamber 52, through outlet 56, into the metering valve assembly 60, through passageway 68, through ports 72, into the annulus 73, across the seat 80, into the hollow passageway 82, through ports 44, and into the low pressure area 42 where the fuel is mixed with air and flows on to the intake manifold of the internal combustion engine.

Movement of lever 32 axially rotates shaft 38 thereby moving the butterfly to increase the free cross-sectional area through which air from 12 can flow. Simultaneously, the threads 67 and 78 are unthreaded so that the needle valve element 70 is backed off from the valve seat 80, thereby enabling fuel to flow across the area or annular space formed therebetween. As the butterfly continues to open respective to the passageway through the carburetor, the needle valve element 70 is progressively further removed from the seat 80 so that the fuel flow across the seat is proportional to the flow passageway formed between the butterfly and the carburetor throat.

The resilient seal 64 is compressed between neck 63 and end 74 of the shaft thereby preventing fuel flow along the threaded surface 67 and 78. The bracket 62 is made of resilient material so that axial movement of the shaft 38 causes the stationary metering apparatus 60 to move towards and away from seat 80 as the resilient bracket is sprung toward or away from the butterfly.

Figure 4:
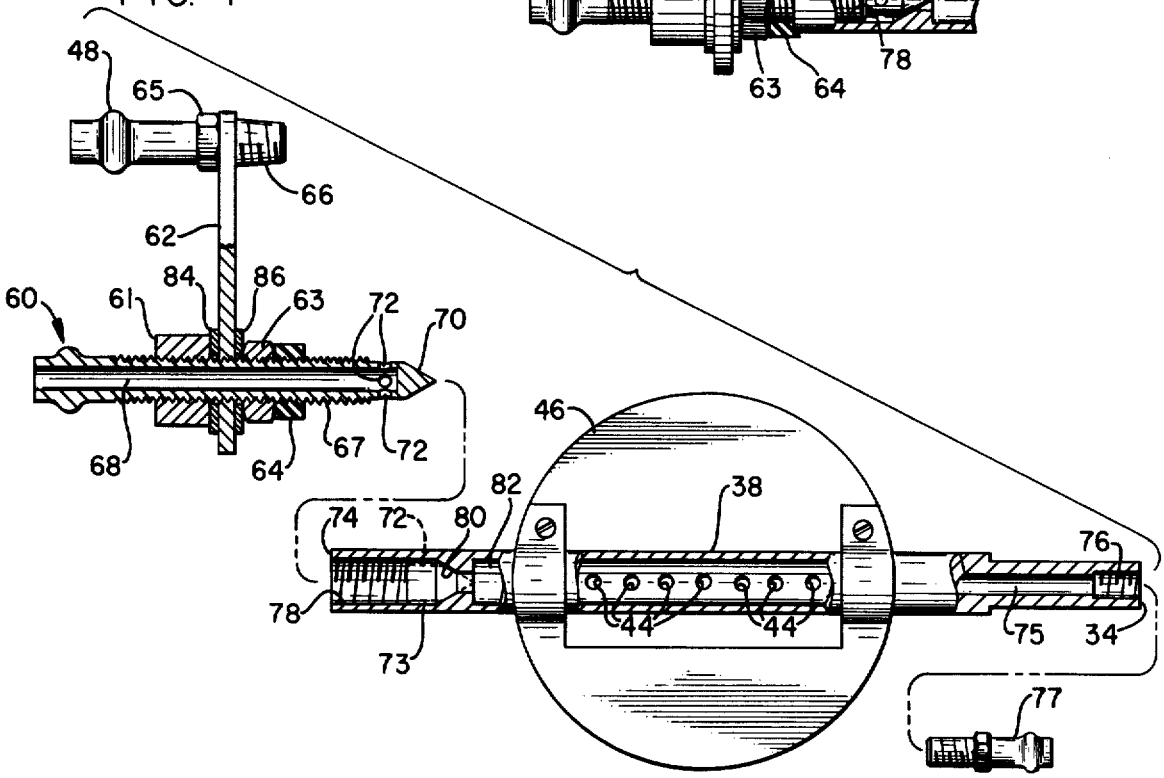

The present invention can be assembled in the illustrated manner of FIG. 4 and marketed as a modification kit to be incorporated into various different carburetors such as exemplified by FIG. 1.

The bracket 62 can be bent as may be required in order to provide an offset to facilitate mounting the apparatus of the present invention to several different prior art type carburetors.

The float chamber 52 preferably is mounted and the fuel level 55 thereof adjusted so that it is maintained at a level slightly below outlet ports 44 of the hollow shaft, so that fuel will not leak into the intake manifold when the internal combustion engine is not running.

The apparatus is assembled by installing the hollow shaft and butterfly into the operative configuration of FIG. 1, and thereafter placing nut 63 and seal 64 about the needle valve assembly. The needle valve assembly is next threadedly fitted into the hollow shaft end at 78 and the bracket 62 thereafter positioned in the illustrated manner of FIG. 1 by affixing the bracket to the main hollow body portion 20 utilizing the threaded flow connection 48. Nut 61 is made up on thread 67 thereby securing the needle valve assembly to the bracket and hence to the main hollow body of the carburetor.

I claim:

1. A fuel control apparatus comprising a main hollow body having one end open to atmosphere and adapted to be connected at the other end to the intake manifold of an internal combustion engine;

a hollow shaft mounted transversely in said hollow body with opposed marginal ends extending therefrom, a butterfly valve element mounted on said hollow shaft within said main body and arranged to that axial rotation of said shaft moves said butterfly valve element from a closed to an opened position, and vice versa, thereby controlling flow through said main hollow body;

a marginal end of said hollow shaft being threaded, fuel flow ports drilled laterally into a medial part of said shaft in proximity of said butterfly valve, a valve seat formed within said hollow shaft between said threaded end and said fuel flow ports;

a needle valve assembly having a valve element on one end, a fuel inlet end, a radial fuel port, and a threaded marginal area which threadedly engages the threaded end of said shaft while said valve element engages said seat to thereby preclude fuel flow when said shaft is rotated one direction, and progressively increases fuel flow therethrough when said shaft is rotated an opposite direction;

a bracket affixed to said main body and extending therefrom and into engagement with said needle valve assembly;

and means by which the needle valve assembly can be adjustably positioned respective to said bracket and seat so that the fuel flow through said seat is proportional to the flow of air across the butterfly valve.

2. The fuel control apparatus of claim 1 wherein said needle valve assembly is an elongated body having a threaded external surface, a valve element formed at one end thereof, a passageway extending axially through said body into proximity of said valve element, said port being formed between said threaded external surface and said valve element so that fuel can flow towards said seat.

3. The fuel control apparatus of claim 1 wherein said needle valve assembly is adjustably received respective to said bracket by the provision of spaced fastener means threadedly engaging said threaded marginal end thereof with said bracket being located therebetween.

4. The fuel flow control apparatus of claim 1, and further including a fuel float chamber flow connected to said needle valve assembly and to a source of fuel so that a fuel supply is made available to the needle valve assembly.

5. The fuel control apparatus of claim 1 wherein said needle valve assembly is an elongated body having a threaded external surface, a valve element formed at one end thereof, a passageway extending axially through said body into proximity of said valve element, a radial port formed between said threaded external surface and said valve element through which fuel can flow towards said seat;

said needle valve assembly being adjustably received respective to said bracket by the provision of spaced fastener means which threadedly engage said threaded marginal end thereof with said bracket being located therebetween.

6. The fuel flow control apparatus of claim 1, and further including a fuel float chamber means which is flow connected to said needle valve assembly and to a source of fuel so that a fuel supply is made available to the needle valve assembly;

said needle valve assembly is adjustably received respective to said bracket by the provision of spaced fastener means threadedly engaging said threaded marginal end thereof, with said bracket being located therebetween.

7. The fuel control apparatus of claim 1 wherein said needle valve assembly is an elongated body having a threaded external surface, a valve element formed at one end thereof, a passageway extending axially through said body into proximity of said valve element, a port formed between said threaded external surface and said valve element through which fuel can flow towards said seat;

and further including a fuel float chamber flow connected to said needle valve assembly and to a source of fuel so that a fuel supply is made available to the needle valve assembly.

* * * * *